US010859069B2

(12) United States Patent
Draper et al.

(10) Patent No.: US 10,859,069 B2
(45) Date of Patent: Dec. 8, 2020

(54) TORQUE CONTROL SYSTEM FOR A VARIABLE DISPLACEMENT PUMP

(71) Applicant: EATON CORPORATION, Cleveland, OH (US)

(72) Inventors: Don Rulon Draper, Chanhassen, MN (US); Robert Leslie Isaacs, Buffalo, MN (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 315 days.

(21) Appl. No.: 15/549,723

(22) PCT Filed: Feb. 8, 2016

(86) PCT No.: PCT/US2016/016981
§ 371 (c)(1),
(2) Date: Aug. 9, 2017

(87) PCT Pub. No.: WO2016/130469
PCT Pub. Date: Aug. 18, 2016

(65) Prior Publication Data

US 2018/0045185 A1 Feb. 15, 2018

Related U.S. Application Data

(60) Provisional application No. 62/113,901, filed on Feb. 9, 2015, provisional application No. 62/238,469, filed on Oct. 7, 2015.

(51) Int. Cl.
*F04B 1/324* (2020.01)
*F04B 49/12* (2006.01)
(Continued)

(52) U.S. Cl.
CPC ..... *F04B 1/324* (2013.01); *F04B 49/002* (2013.01); *F04B 49/08* (2013.01); *F04B 49/12* (2013.01);
(Continued)

(58) Field of Classification Search
CPC ..... F04B 1/324; F04B 49/002; F04B 49/08; F04B 49/12; F04B 49/22; F04B 1/2078; F04B 1/295; F04B 27/22; F04B 2205/04
(Continued)

(56) References Cited

U.S. PATENT DOCUMENTS 2,403,371 A * 7/1946 Ifield ..... F04B 1/2035 417/218
2,732,808 A 1/1956 Stoyke
(Continued)

FOREIGN PATENT DOCUMENTS

FR 2 375 467 7/1978

OTHER PUBLICATIONS

International Search Report and Written Opinion of the International Searching Authority for corresponding International Patent Application PCT/US2016/016981 dated Apr. 26, 2016, 10 pages.
(Continued)

*Primary Examiner* — Alexander B Comley
(74) *Attorney, Agent, or Firm* — Merchant & Gould P.C.

(57) ABSTRACT

The present invention relates to a hydraulic pump system including a variable displacement pump that generates an outlet pressure. The hydraulic pump system also includes a control system that decreases a displacement volume of the variable displacement pump in response to an increase in the outlet pressure and increases a displacement volume of the variable displacement pump in response to a decrease in the outlet pressure.

15 Claims, 11 Drawing Sheets

(51) Int. Cl.

| | |
|---|---|
| ***F04B 49/00*** | (2006.01) |
| ***F04B 49/22*** | (2006.01) |
| ***F04B 49/08*** | (2006.01) |
| ***F04B 1/2078*** | (2020.01) |
| ***F04B 1/124*** | (2020.01) |
| ***F04B 1/146*** | (2020.01) |
| ***F04B 1/295*** | (2020.01) |

(52) U.S. Cl.
CPC ..... *F04B 49/22* (2013.01); *F04B 1/124* (2013.01); *F04B 1/146* (2013.01); *F04B 1/2078* (2013.01); *F04B 1/295* (2013.01); *F04B 2205/04* (2013.01)

(58) Field of Classification Search
USPC ..... 417/222.1, 269; 92/13; 137/625.67, 137/625.69
See application file for complete search history.

(56) References Cited

U.S. PATENT DOCUMENTS 3,403,628 A * 10/1968 Bobst ..... F04B 49/002 417/222.1
3,489,094 A * 1/1970 Vanzee ..... F04B 49/08 417/53
3,753,627 A * 8/1973 Ward ..... F04B 1/324 417/213
3,859,790 A * 1/1975 Bacquie ..... F04B 49/007 60/422
3,861,145 A * 1/1975 Hall ..... F15B 13/0417 60/427
4,013,380 A * 3/1977 Pensa ..... F04B 49/002 417/218
4,072,442 A * 2/1978 Horiuchi ..... F04B 49/08 417/218
4,143,996 A * 3/1979 Sullivan ..... F04B 9/02 417/15
4,205,590 A * 6/1980 Stegner ..... F04B 1/324 91/359
4,715,788 A * 12/1987 Kouns ..... F04B 1/324 417/218
4,723,892 A * 2/1988 Cowan ..... F04B 1/324 417/222.1
4,896,585 A * 1/1990 Forster ..... F01B 3/02 74/60
5,123,815 A * 6/1992 Larkin ..... F04B 49/022 417/218
6,033,188 A * 3/2000 Baldus ..... F04B 49/08 417/222.1
6,095,760 A * 8/2000 Houtman ..... F04B 1/324 417/218
7,243,492 B2 * 7/2007 Niidome ..... F04B 1/324 60/443
7,967,574 B2 * 6/2011 Achten ..... F04B 1/2007 417/269
8,845,303 B2 9/2014 Wang
2004/0000142 A1 1/2004 Nunomura
2010/0236399 A1 * 9/2010 Gulati ..... F04B 1/324 91/505
2011/0079006 A1 4/2011 Du
2012/0186441 A1 * 7/2012 Wang ..... F03C 1/0668 91/505
2014/0157765 A1 * 6/2014 Krittian ..... F16H 61/42 60/433

OTHER PUBLICATIONS

Extended European Search Report, EP 16 74 9661, dated Aug. 14, 2018, 9 pages.

* cited by examiner

TORQUE CONTROL SYSTEM FOR A VARIABLE DISPLACEMENT PUMP

CROSS-REFERENCE TO RELATED APPLICATIONS

This application is a National Stage Application of PCT/US2016/016981, filed on Feb. 8, 2016, which claims the benefit of U.S. Patent Application Ser. No. 62/113,901, filed on Feb. 9, 2015, and claims the benefit of U.S. Patent Application Ser. No. 62/238,469, filed on Oct. 7, 2015, the disclosures of which are incorporated herein by reference in their entireties. To the extent appropriate, a claim of priority is made to each of the above disclosed applications.

TECHNICAL FIELD

The present disclosure relates generally to hydraulic systems. More particularly, the present disclosure relates to hydraulic systems including variable displacement pumps.

BACKGROUND

Hydraulic systems are used to transfer energy using hydraulic pressure and flow. A typical hydraulic system includes one or more hydraulic pumps for converting energy/power from a power source (e.g., an electric motor, a combustion engine, etc.) into hydraulic pressure and flow used to provide useful work at an actuator or other device (i.e., a load). A typical hydraulic pump includes a rotating group that includes one or more pistons carried within cylinders defined by a rotor coupled to an input shaft. The input shaft supplies torque for rotating the rotating group. As the rotating group rotates about a central axis of the input shaft, the pistons reciprocate (i.e., stroke) within the cylinders of the rotating group. This causes hydraulic fluid to be drawn into an input port of the pump and discharged from an output port of the pump. In a variable displacement pump, the volume of fluid displaced by the pump for each rotation of the rotating group (i.e., the displacement volume of the pump) can be varied to match hydraulic pressure and flow demands corresponding to the load. Typically, the displacement volume of a pump is varied by varying the stroke length of the pistons of the rotating group within their corresponding cylinders. The workload experienced by hydraulic pumps is dependent upon factors such as the working pressure and the pump output flow. In some operating conditions, the torque required to drive the pump to satisfy a given workload may exceed the capacity of the power source.

SUMMARY

One aspect of the present disclosure relates to a torque control system for a variable displacement pump that reduces the pump output flow when the driving effort reaches a threshold set by the torque control system thereby preventing the power source from overloading.

Another aspect of the present disclosure relates to a torque control system for a variable displacement pump that decreases a stroke length of the variable displacement pump in response to an increase in pump outlet pressure and increases the stroke length of the variable displacement pump in response to a decrease in pump outlet pressure.

A further aspect of the present disclosure relates to a hydraulic pump system including a variable displacement pump that generates an outlet pressure. The system also includes a control system that decreases a displacement volume of the variable displacement pump in response to an increase in the outlet pressure and increases a displacement volume of the variable displacement pump in response to a decrease in the outlet pressure.

Other aspects of the present disclosure relates to a control system for a variable displacement pump having a torque control function that automatically adjusts the pump displacement in response to load pressure. In certain examples, the control system reduces displacement at higher pressures to limit the input torque demand. In this way, a torque limit is maintained across a range of operating pressures, speeds and oil temperature. This use of torque control allows for higher flow at low pressure while maintaining the ability to achieve high pressure without exceeding the torque capacity of the power source (e.g., motor or engine) driving the pump.

Other aspects of the present disclosure relate to variable displacement pump controlled by control system including torque control valve in which a spring preload alone of the torque control valve governs a torque limit of the pump.

A variety of additional inventive aspects will be set forth in the description that follows. The inventive aspects can relate to individual features and to combinations of features. It is to be understood that both the forgoing general description and the following detailed description are exemplary and explanatory only and are not restrictive of the broad inventive concepts upon which the examples disclose herein are based.

DETAILED DESCRIPTION

Figure 1:
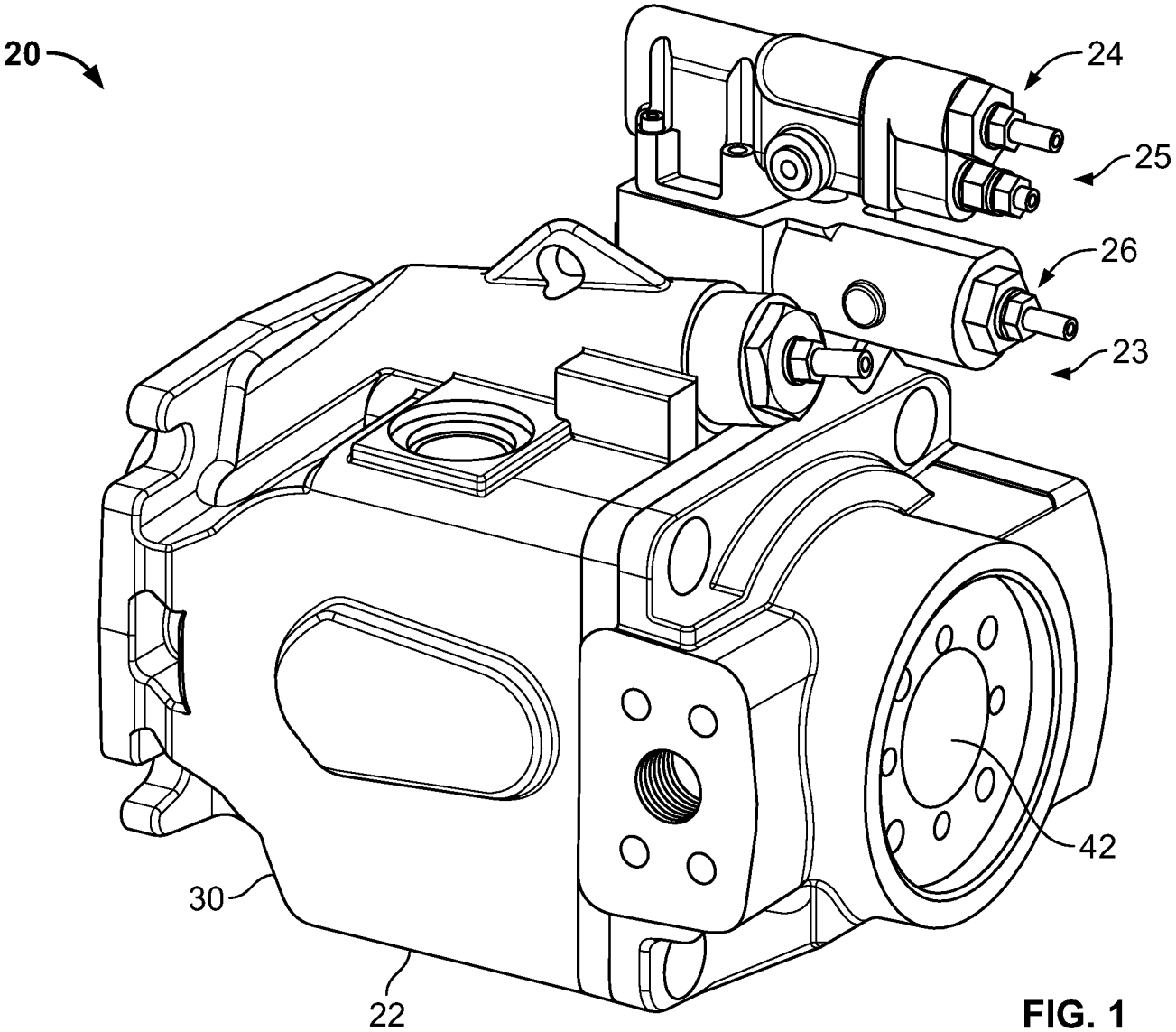
FIG. 1 is in perspective view of a variable displacement pump system in accordance with the principles of the present disclosure.
Figure 2:
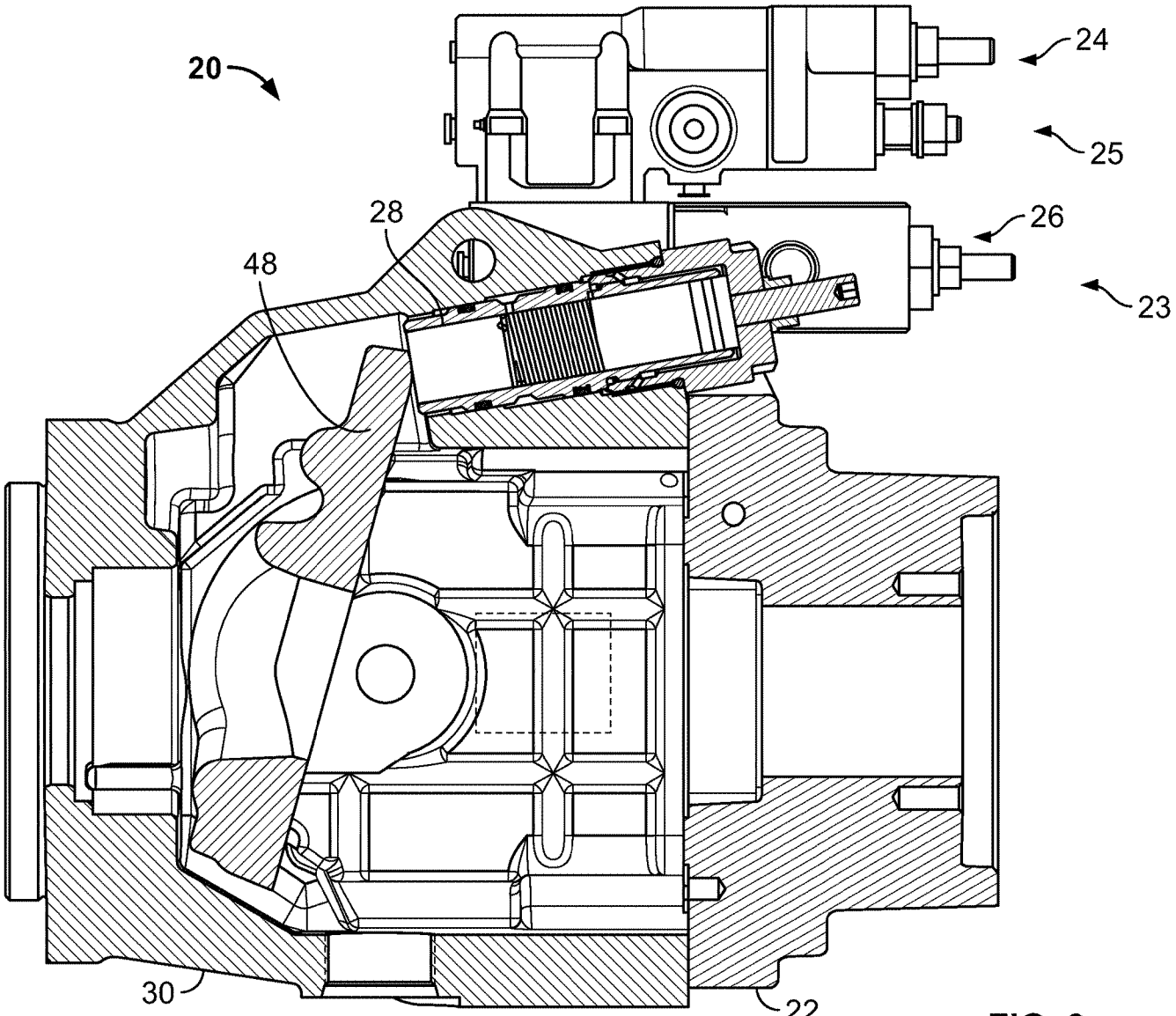
FIG. 2 is a cross-sectional view of the variable displacement pump system of FIG. 1.
Figure 3:
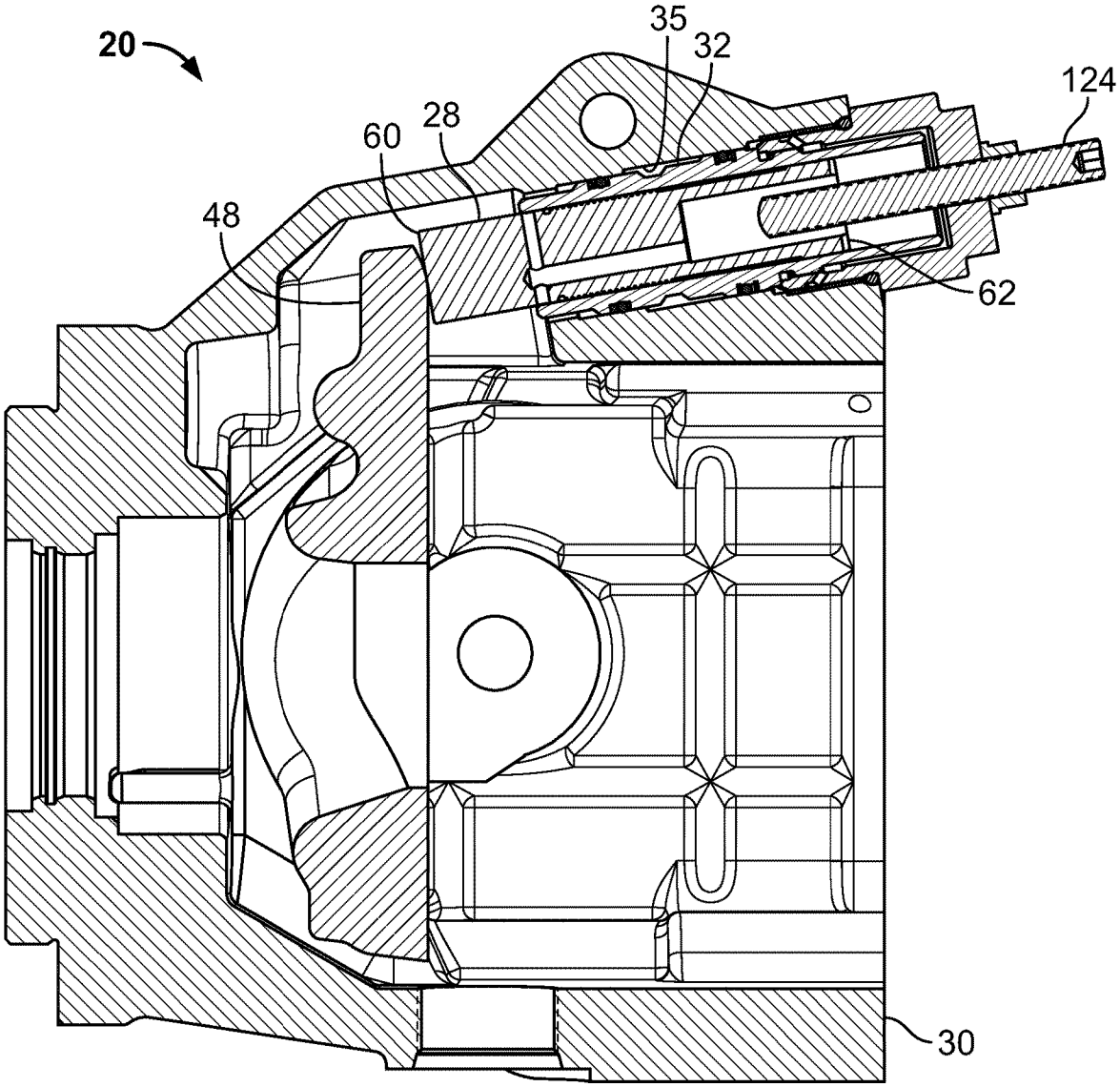
FIG. 3 is another cross-sectional view of the variable displacement pump system of FIG. 1.
Figure 4:
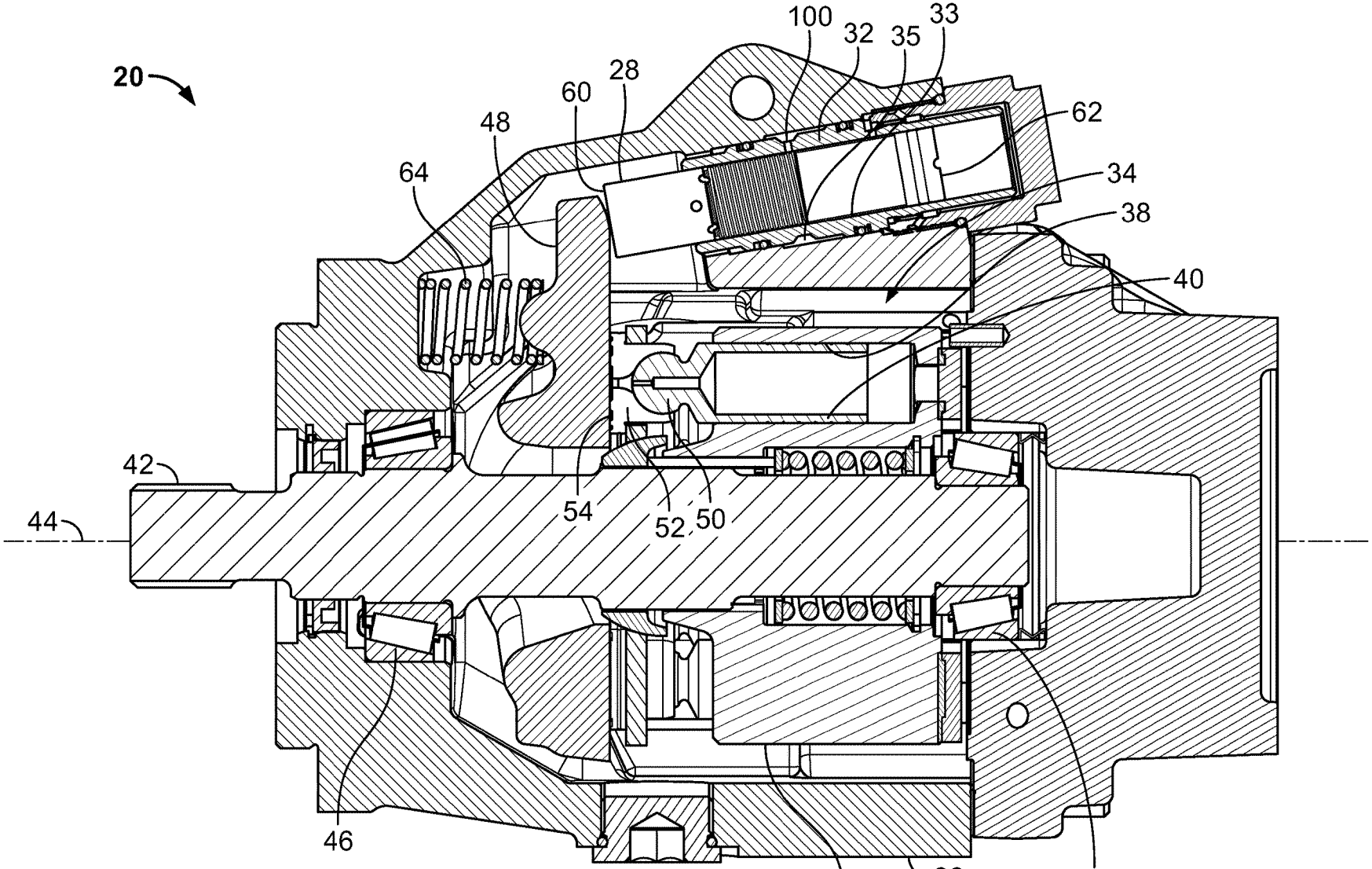
FIG. 4 is another cross-sectional view of the variable displacement pump system of FIG. 1.
Figure 5:
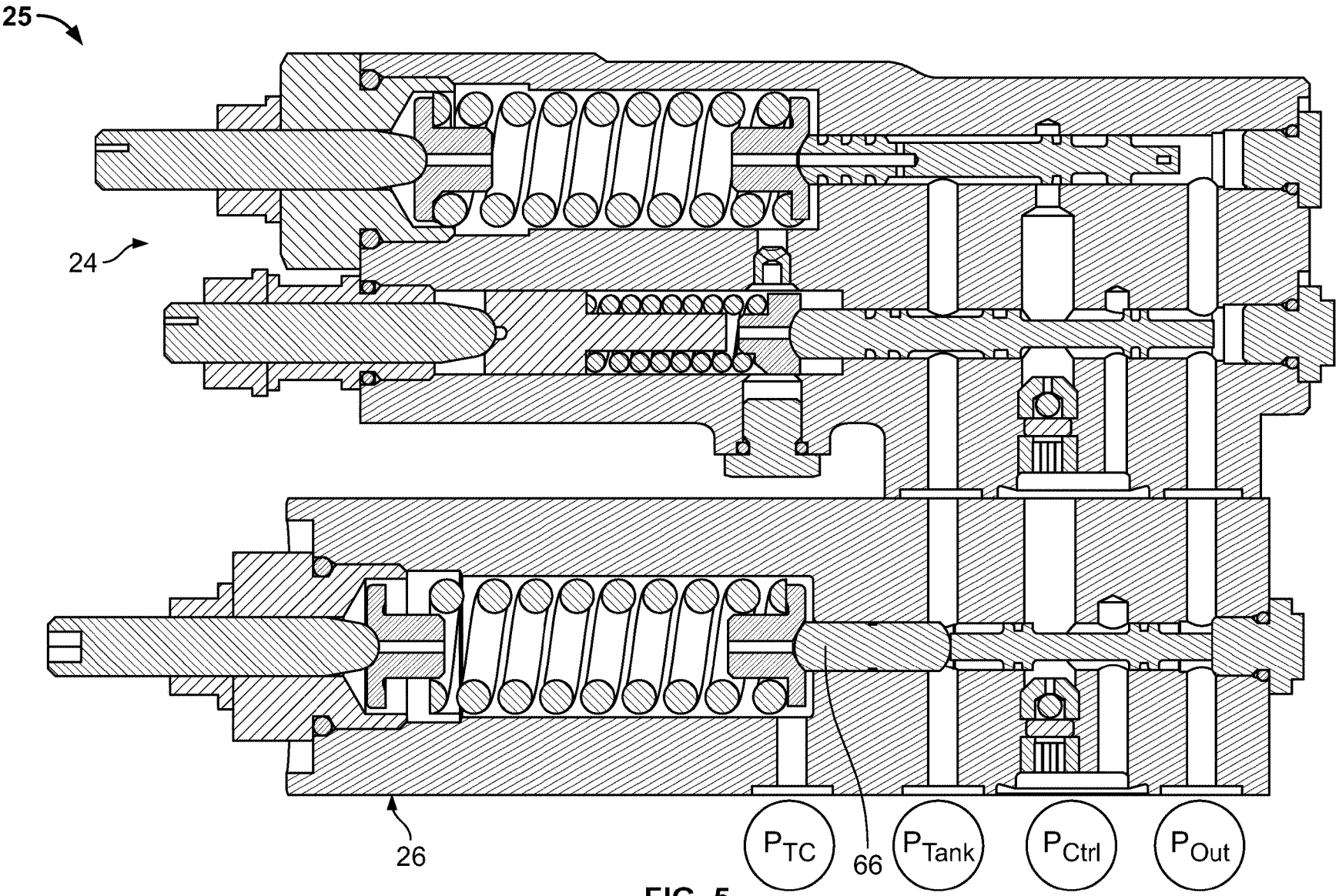
FIG. 5 is a cross-sectional view taken through a control valve stack of the variable displacement pump system of FIG. 1.

FIG. 1 illustrates a variable displacement pump system 20 in accordance with the principles of the present disclosure. The variable displacement pump system 20 includes a variable displacement pump 22 controlled by a pump control system 23. The pump control system 23 includes a valve stack 25 having a pressure compensation valve arrangement 24 and a torque control valve 26. The pump control system 20 also includes a control piston 28 for controlling a position of a swash plate 48 of the variable displacement pump 22. FIGS. 2-4 are various cross-sectional views showing how the control piston 28 interfaces with the swash plate 48. FIG. 5 is a cross-sectional view taken through the valve stack 25.

As best shown at FIG. 4, the variable displacement pump 22 includes a control piston sleeve 32 that is mounted within a control piston cylinder 35 defined by a housing 30 of the pump 22. The control piston sleeve 32 defines a bore 33 in which the control piston 28 is mounted. Although it is primarily described in the present disclosure that the sleeve 32 is mounted within the control piston cylinder 35 defined by the housing 30 of the pump 22, it is also possible that the sleeve 32 is formed to be integral with the pump housing 30. In yet other embodiments, the housing 30 of the variable displacement pump 22 is configured to define the bore 33 without the control piston sleeve 32. For example, at least a portion of the control piston cylinder 35 is configured to replace the control piston sleeve 32 so that the control piston 28 is mounted directly within the control piston cylinder 35 (i.e., the control piston cylinder 35 defines the bore 33 without the control piston sleeve 32). In this configuration, the control piston cylinder 35, and/or at least a portion of the pump housing 30 that is associated with the control piston cylinder 35, includes features corresponding to the features of the control piston sleeve 32 as described in the present disclosure.

With continued reference to FIG. 4, the variable displacement pump 22 includes a rotating group 34 mounted within the pump housing 30. The rotating group 34 includes a rotor 36 defining a plurality of piston cylinders 38 that receive pistons 40. The variable displacement pump 22 also includes an input shaft 42 that defines an axis of rotation 44. The input shaft 42 is coupled to the rotor 36 such that torque can be transferred from the input shaft 42 to the rotor 36 thereby allowing the input shaft 42 and the rotor 36 to rotate together about the axis of rotation 44. In certain examples, a splined connection can be provided between the input shaft 42 and the rotor 36. As depicted, bearings 46 are provided between the input shaft 42 and the pump housing 30 for allowing the input shaft 42 to rotate relative to the pump housing 30 about the axis of rotation 44.

Figure 6:
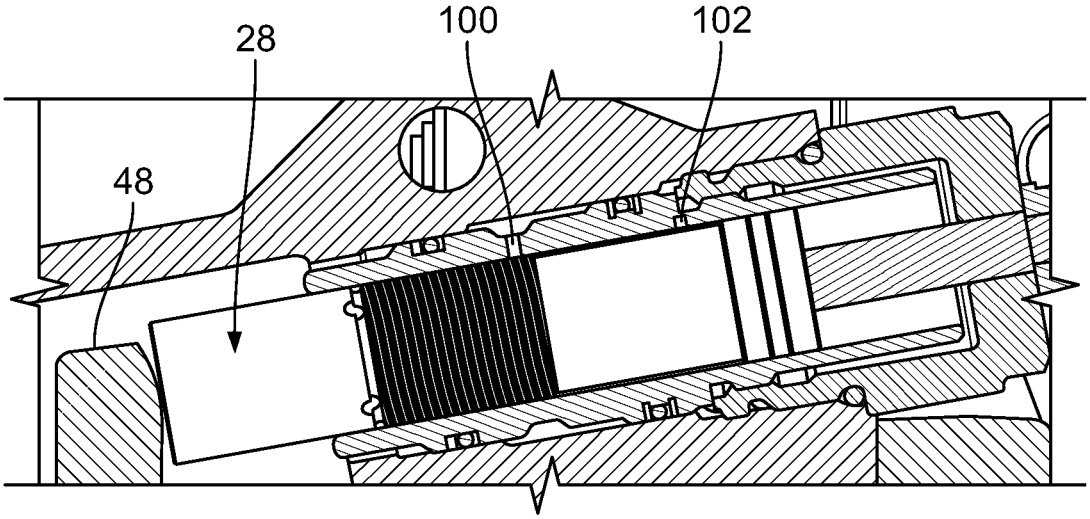
FIG. 6 is a cross-sectional view of the variable displacement pump system of FIG. 1 showing a swash plate position control piston in a neutral position (i.e., a minimum pump displacement position)
Figure 7:
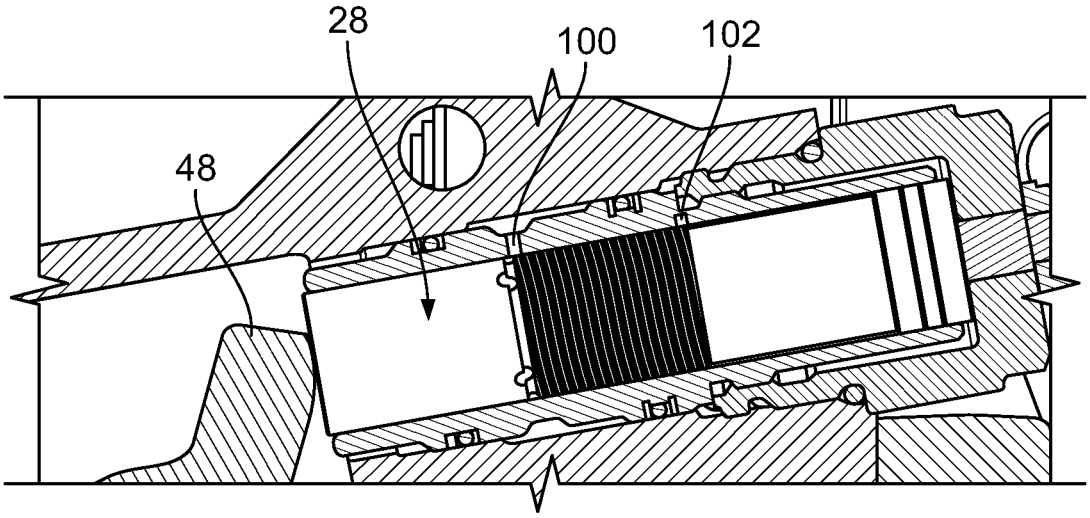
FIG. 7 is a cross-sectional view of the variable displacement pump system of FIG. 7 showing the swash plate position control piston in a maximum pump displacement position.

Still referring to FIG. 4, the swash plate 48 is also positioned within the pump housing 30. The swash plate 48 is pivotally movable relative to the axis of rotation 44 between a neutral position (see FIGS. 3, 4, and 6) and a maximum displacement position (see FIGS. 2 and 7). The neutral position can also be referred to as a minimum displacement position. It will be appreciated that movement of the swash plate 48 varies an angle of swash plate 48 relative to the axis of rotation 44. Varying the angle of the swash plate 48 relative to the axis of rotation 44 varies the displacement volume of the variable displacement pump 22. The displacement volume is the amount of hydraulic fluid displaced by the variable displacement pump 22 for each rotation of the rotating group 34. When the swash plate 48 is in the neutral position, the pump displacement has a minimum value. In certain examples, the minimum value can be zero displacement. When the swash plate 48 is in the maximum displacement position, the variable displacement pump 22 has a maximum displacement value.

Figure 8:
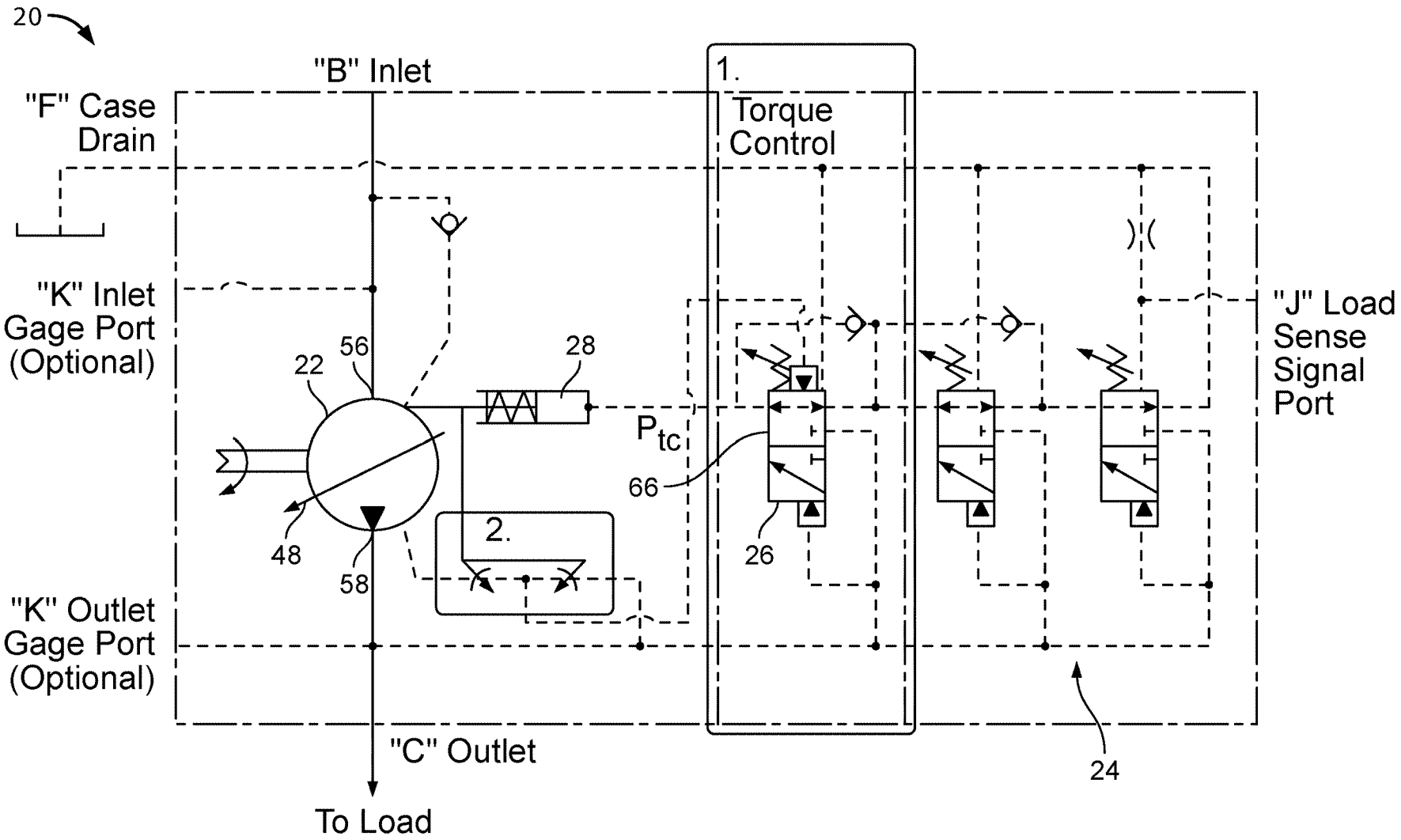
FIG. 8 is a schematic view of the variable displacement pump system of FIG. 1.

Referring still to FIG. 4, the pistons 40 of the rotating group 34 include cylindrical heads 50 on which hydraulic shoes 52 are mounted. The hydraulic shoes 52 have end surfaces 54 that oppose the swash plate 48. Typically, hydraulic fluid provides a hydraulic bearing layer between the end surfaces 54 and the swash plate 48 that facilitates rotating the rotating group 34 about the axis of rotation 44 relative to the swash plate 48. When the swash plate 48 is in the neutral position, the swash plate is generally perpendicular relative to the axis of rotation 44 thereby causing a stroke length of the pistons 40 within their respective piston cylinders 38 to be at or near zero. By adjusting the angle of the swash plate 48 relative to the axis of rotation 44, the stroke length of the pistons 40 within their corresponding piston cylinders 38 is adjusted. When the swash plate 48 is positioned at a non-perpendicular angle relative to the axis of rotation 44, the pistons reciprocate one stroke length for each rotation of the rotor 36 about the axis of rotation 44. The stroke length increases as the swash plate 48 is moved from the neutral position toward the maximum displacement position. As the pistons 40 reciprocate within their corresponding piston cylinders 38, the rotating group 34 provides a pumping action that draws hydraulic fluid into an inlet 56 (see schematically at FIG. 8) of the variable displacement pump 22 and forces hydraulic fluid out of an outlet 58 (see schematically at FIG. 8) of the variable displacement pump 22.

The control piston 28 is used to control the position or angle of the swash plate 48 relative to the axis of rotation 44. The control piston 28 includes a first end 60 and an opposite second end 62. The first end 60 of the control piston 28 is shown engaging the swash plate 48. A spring 64 is provided within the pump housing 30 for biasing the swash plate 48 toward the maximum displacement position. The angle of the swash plate 48 relative to the axis of rotation 44 is adjusted by moving the control piston 28 axially within the sleeve 32 (or the control piston cylinder 35 where the system 20 is configured without the sleeve 32). In certain examples, a control pressure is applied to the second end 62 of the control piston 28 to cause the control piston 28 to move the swash plate 48 from maximum displacement position toward the neutral position. The force applied by the control pressure to the second end 62 of the control piston 28 must exceed the spring force of the spring 64 and other forces to move the swash plate 48 from the maximum displacement position toward the neutral position. Such other forces include hydraulic forces introduced by the pressures within the piston cylinders 38 and transmitted to the swash plate 48 via the pistons 40 and through the shoes 52. When the force applied to the second end 62 of the swash plate control piston 28 is less than a combination of the spring force of the spring 64 and the other forces, the combination of the forces moves the swash plate 48 back towards the maximum displacement position.

It will be appreciated that the control system of the variable displacement pump 22 can provide a torque control function. In certain examples, various elements can cooperate to provide the torque limiting function of the pump. In one example, the torque control valve 26 and the control piston 28 can cooperate to provide the torque limiting function. In certain examples, the torque control valve 26 can function similar to a load sense or pressure compensator valve, and the control piston 28 can include an integrated hydraulic potentiometer that generates a torque limiting pressure signal $P_{tc}$ which interfaces with the torque control valve 26 to provide a pressure balancing function with respect to a spool 66 of the torque control valve 26.

Figure 9:
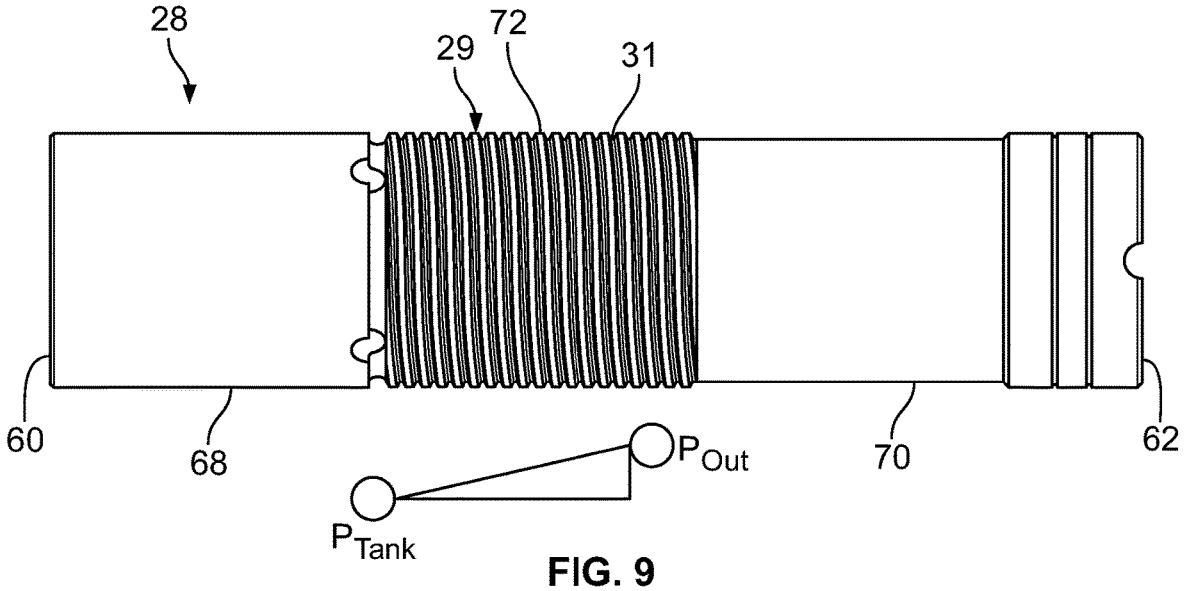
FIG. 9 is a side view of the swash plate position control piston of the variable displacement pump assembly of FIG. 1.

The control piston 28 having an integral potentiometer 29 is shown at FIG. 9. Referring to FIG. 9, the control piston 28 includes a first zone 68 positioned nearest the first end 60 of the control piston 28 and a second zone 70 positioned nearest the second end 62 of the control piston 28. The control piston 28 also includes a third zone 72 positioned between the first and second zones 68 and 70. In certain examples, the first and second zones 70 have generally smooth, cylindrical surfaces. In certain examples, the third zone 72 has an integrated structure that can function as the hydraulic potentiometer 29. In certain examples, the structure can include a helical groove 31 (e.g., similar to a thread), that permits the passage of laminar flow across the third zone 72 between the first and second zones 68, 70. The hydraulic pressure of fluid passing through the third zone 72 along the helical groove will decrease in a linear manner from one end to the other of the helical groove. The hydraulic pressure along the second zone 70 can be generally the same throughout and similarly the hydraulic pressure along the first zone 68 can be generally the same throughout. In certain examples, the hydraulic pressure provided to the first zone 68 is case pressure of the pump housing (i.e., essentially tank/reservoir/drain pressure).

In certain examples, the second zone 70 can be in fluid communication with the outlet 58 (schematically shown in FIG. 8) of the pump 22 so as to be generally at outlet pressure. Thus, under many operating conditions, the hydraulic pressure at the second zone 70 is substantially higher than the hydraulic pressure at the first zone 68. This causes hydraulic fluid to flow along the helical groove at the third zone 72 such that the hydraulic fluid flows along a helical path that extends circumferentially around the control piston 28 as the path extends axially along the length of the control piston 28. When the hydraulic fluid flows along the helical groove, the pressure of the hydraulic fluid will decrease in a linear manner as the hydraulic fluid flows from the second zone 70 toward the first zone 68.

Figure 10:
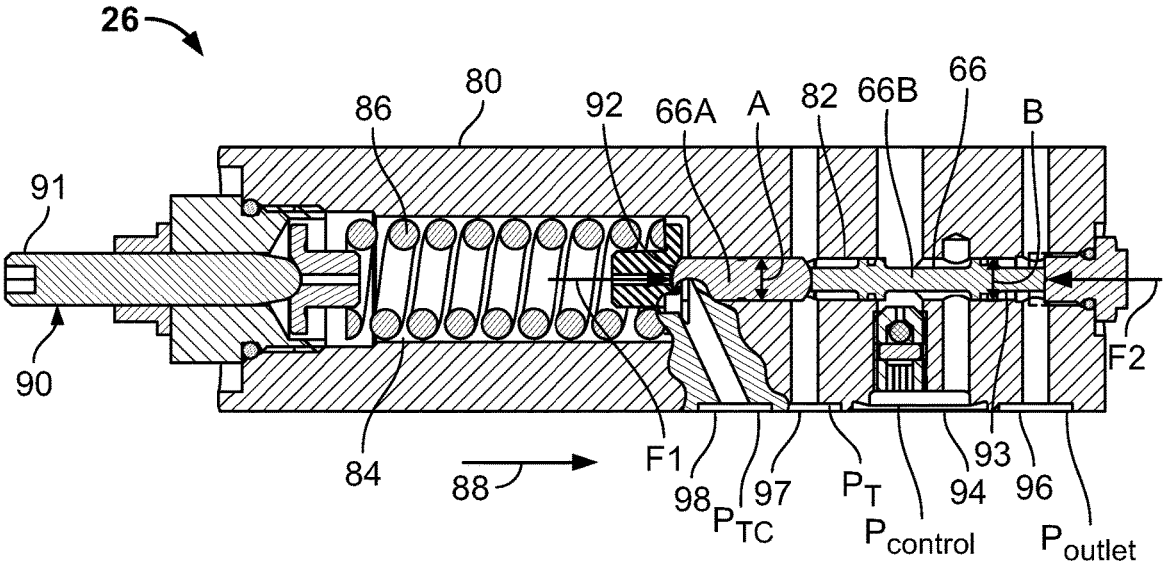
FIG. 10 is a cross-sectional view of a torque control valve of the variable displacement pump system of FIG. 1.

Referring to FIG. 10, the torque control valve 26 of the variable displacement pump 22 includes a valve body 80 defining a bore 82 in which a valve spool 66 is mounted. The valve body 80 also defines a spring chamber 84 containing a spring 86. The spring 86 applies a spring force in a first direction 88 to the spool 66 (i.e., a pre-load). In certain examples, the spring load or force corresponding to the spring 86 sets a maximum torque limit of the variable displacement pump 22. In certain examples, the torque control valve 26 can include a spring pre-load adjustment mechanism 90 which allows the spring pre-load of the spring 86 to be manually adjusted. In certain examples, the spring pre-load adjustment mechanism 90 includes a threaded member 91 (i.e., a bolt or screw) that can be turned to adjust the spring pre-load and thereby adjust the torque limit of the pump. In certain examples, the spring pre-load adjustment mechanism 90 allows the torque setting of the pump to be adjusted without any disassembly.

Figure 13:
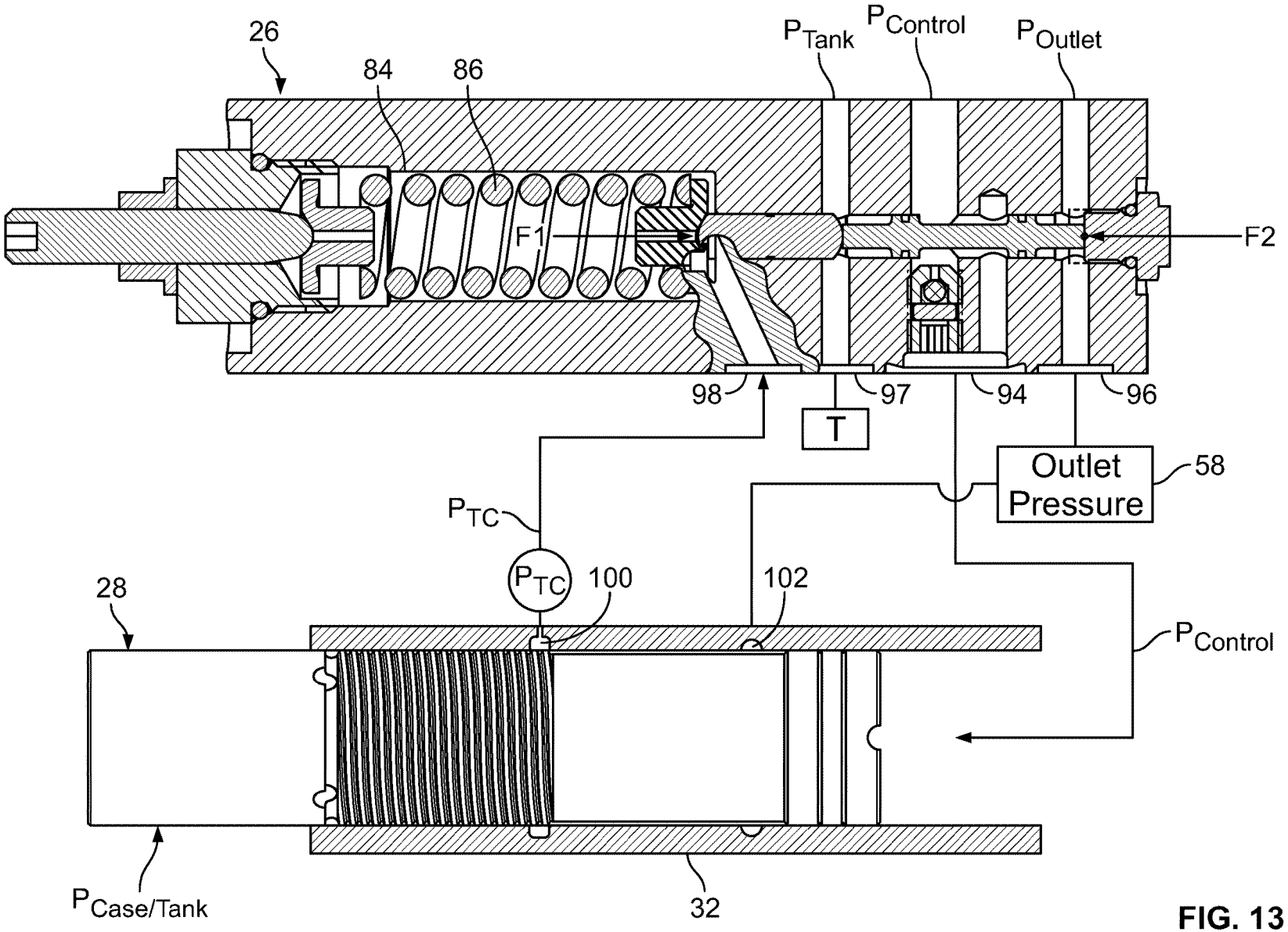
FIG. 13 schematically shows a hydraulic fluid connection arrangement between the torque control valve and the swash plate position control piston of the variable displacement pump system of FIG. 1.

In certain examples, the torque control valve 26 includes a first port 94 in fluid communication with the second end 62 of the control piston 28, a second port 96 in fluid communication with the outlet 58 of the pump 22 and a third port 98 in fluid communication with the potentiometer 29 of the control piston 28. The first port 94 provides control pressure to the second end 62 of the control piston 28. Another port 97 is in fluid communication with tank pressure. FIG. 13 shows an example fluid connection arrangement between the control piston 28 and the control valve 26.

It will be appreciated that the spool 66 is configured to move axially within the bore 82. Some embodiments of the spool 66 can be subdivided into two or more individual parts (e.g., 66A and 66B in FIG. 10). In some embodiments, at least one of the individual parts of the spool 66 can be of different diameters. In other embodiments, the individual parts of the spool 66 can have the same diameter. Opposing axial forces are applied to opposite first and second ends 92, 93 of the spool 66 to control the axial position of the spool 66 within the bore 82. For example, the spring force from spring 86 as well as pressure within the spring chamber 84 cooperate to apply a first axial force F1 to the first end 92 of the spool 66. The pressure within the spring chamber 84 is determined by a signal pressure $P_{tc}$ received from the potentiometer of the control piston 28. The force applied to the spool 66 by the signal pressure $P_{tc}$ can be referred to as a signal pressure force. A second force F2 is applied to the second end 93 of the spool 66. The second force F2 is generated by the outlet pressure of the pump applied against the second end 93 of the spool 66. This force F2 can be referred to as an outlet pressure force. The forces F1 and F2 are opposite each other and can dynamically change toward a balanced condition.

Referring to FIG. 13, when the force F2 exceeds the force F1 (typically as a result of increased outlet pressure), the spool 66 is caused to move to the left thereby opening fluid communication between the port 96 and the port 94. In this way, pump outlet pressure from the port 96 is provided to the port 94. The increased pressure provided by the pump outlet pressure increases the control pressure provided to the second end 62 of the control piston 28 causing the control piston 28 to move the swash plate toward the neutral position thereby reducing the stroke length of the hydraulic pump 22 such that the pump displacement is decreased. Movement of the control piston 28 toward the neutral position combined with the increase in outlet pressure causes the magnitude of the signal pressure provided to the spring chamber 84 from the potentiometer 29 to increase thereby causing the force F1 to increase to a point where F1 exceeds F2 and the spool moves back to the right thereby closing fluid communication between the ports 96, 94. The system operates such that the forces F1 and F2 iteratively adjust toward a re-balanced condition.

When the force F2 falls below the force F1 (typically as a result of decreased outlet pressure), the spool 66 moves to the right to a position where the port 94 is placed in fluid communication with tank pressure via port 97 thereby reducing the magnitude of the control pressure provided to the second end 62 of the control piston 28. This reduction in control pressure causes the control piston 28 to allow the swash plate to be spring biased back toward the maximum displacement position such that the stroke length of the pistons is increased to increase the displacement volume of the pump. Movement of the control piston 28 toward the maximum displacement position combined with the decrease in outlet pressure causes the magnitude of the signal pressure $P_{tc}$ provided to the spring chamber 84 from the potentiometer 29 to decrease thereby causing the force F1 to decrease to a point where F1 is less than F2 and the spool moves back to the left thereby closing fluid communication between the ports 97, 94. The system operates such that the forces F1 and F2 iteratively adjust toward a re-balanced condition.

Figure 11:
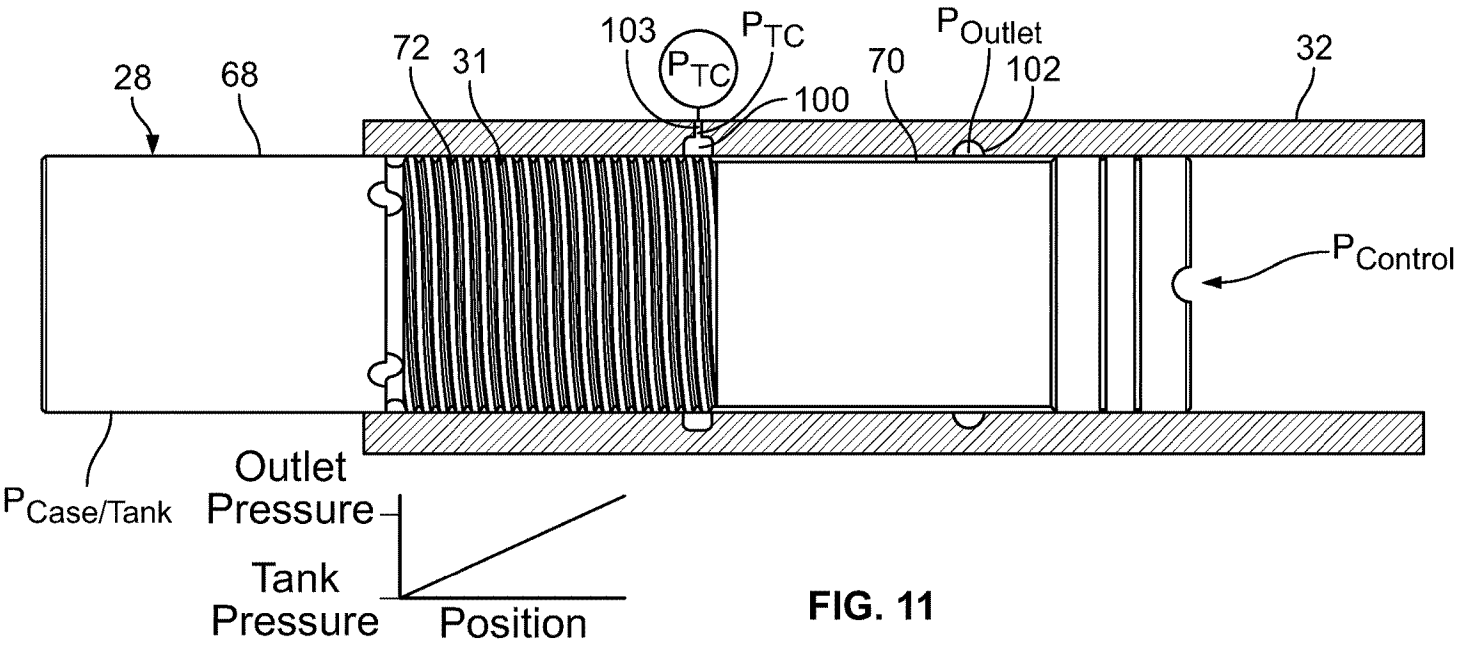
FIG. 11 shows the swash plate position control piston of the variable displacement pump system of FIG. 1 in the neutral position.
Figure 12:
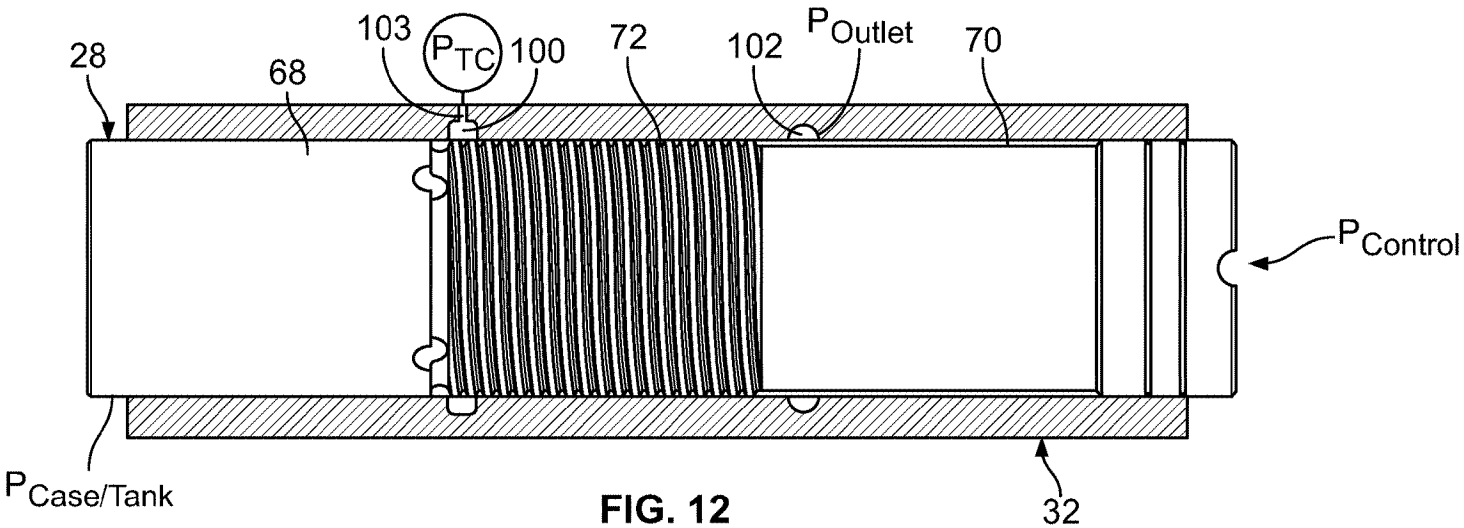
FIG. 12 shows the swash plate control piston of the variable displacement pump system of FIG. 1 in the maximum displacement position.

Referring to FIGS. 11-13, the sleeve 32 (or the control piston cylinder 35 where the system 20 is configured without the sleeve 32) that receives the control piston 28 defines an annulus 100 or other volume (i.e., a signal pressure output location) in fluid communication with the third port 98 of the control valve 26. The annulus 100 is positioned at the interior of the sleeve 32 (or the control piston cylinder 35) and opposes the exterior surface of the control piston 28. In some embodiments, the annulus 100 on the exterior of the sleeve 32 (or the control piston cylinder 35) is in fluid communication with the interior of the sleeve 32 (or the control piston cylinder 35) through a plurality of passages 103. When the control piston 28 is in the maximum displacement position, the annulus 100 and the passages 103 are positioned adjacent the interface between the first zone 68 and the third zone 72. In contrast, when the control piston is in the neutral position, the annulus 100 and the passages 103 are positioned adjacent the interface between the third zone 72 and the second zone 70. The magnitude signal pressure output from the signal pressure output location to the spring chamber 84 generally reduces linearly as the control piston 28 moves toward the maximum displacement position and increases linearly as the control piston moves toward the neutral position.

In certain examples, the sleeve 32 (or the control piston cylinder 35 where the system 20 is configured without the sleeve 32) can also define an internal annulus 102 or volume/space at the second zone 70 that is in fluid communication with the pump outlet. In this way, the region of the sleeve 32 (or the control piston cylinder 35) surrounding the second zone 70 can be provided at pump outlet pressure. In contrast, the region of the sleeve 32 (or the control piston cylinder 35) surrounding the first zone 68 can be provided at case or tank pressure. In this way, when the control piston 28 is in the maximum displacement position, case or tank pressure is provided to the internal annulus 100. Thus, the signal pressure output from the potentiometer 29 corresponds to case or tank pressure and is provided to the spring chamber 84 through the third port 98. In contrast, when the control piston is in the neutral position, pump outlet pressure from the internal annulus 102 is provided to the internal annulus 100. In this way, the signal pressure output from the potentiometer 29 corresponds to pump pressure and is provided to the spring chamber 84 through the third port 98.

As the control piston 28 moves between the neutral position and the maximum displacement position, the hydraulic pressure provided to the internal annulus 100 varies linearly with the position of the control piston 28 since the pressure within the helical groove defined by the control piston 28 decreases in a linear manner from one end to the other. The pressure provided to the annulus 100 is thus dependent upon where the annulus 100 aligns with the third zone 72. When the annulus 100 aligns with a first end of the third zone 72, the hydraulic pressure provided to the annulus 100 is generally pump outlet pressure. When the annulus 100 aligns with the second end of the helical groove, the hydraulic pressure is generally case pressure (i.e., tank or drain pressure). In the region between the first and second ends of the helical groove, the hydraulic pressure provided to the annulus 100 varies linearly from outlet pressure to tank pressure.

In certain examples, the pump control system can be provided with minimum and maximum displacement limit features. In certain examples, the pump will only operate between the minimum and maximum displacements, regardless of operating conditions. This feature can override all other controls such as pressure compensator controls, load sense controls and torque controls.

Figure 14:
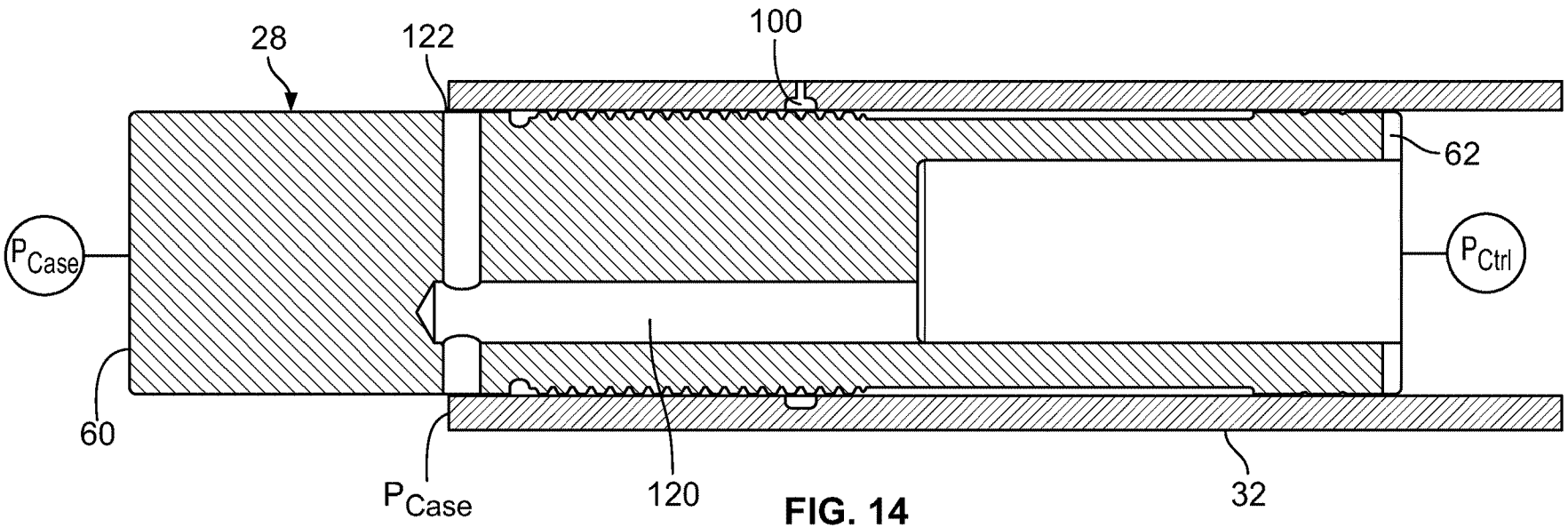
FIG. 14 is a cross-sectional view taken through the swash plate position control piston of the variable displacement pump system of FIG. 1.

In one example, the minimum displacement feature can be accomplished by adding a pressure relief passage 120 (see FIG. 14) to the control piston 28. The pressure relief passage 120 can have a side opening 122 (i.e., a blow hole) that is placed at a desired axial position along the axial length of the control piston 28. When the side opening 122 is placed in fluid communication with case pressure, pressure applied to the second end of the control piston 28 is relieved to control pressure to case\tank thereby reducing the control pressure and preventing the pump from de-stroking further. For example, when the pressure relief hole 122 moves past the end of the sleeve 32 (or the control piston cylinder 35 where the system 20 is configured without the sleeve 32), the second end of the piston 28 is placed in fluid communication with case pressure thereby reducing the control pressure and stopping movement of the piston that would cause further de-stroking of the pump. Thus, the pressure relief hole 122 in combination with the end of the sleeve 32 (or the control piston cylinder 35) functions as a stop.

In certain examples, a maximum displacement feature can include an adjustable actuator such as an adjustment screw 124 that can determine the maximum displacement position of the control piston 28 within the sleeve 32 (or the control piston cylinder 35 where the system 20 is configured without the sleeve 32). In certain examples, the maximum displacement adjustment mechanism can include a stop against which the control piston abuts when in the desired maximum displacement position. By adjusting the axial position of the stop within the sleeve 32 (or the control piston cylinder 35), the maximum displacement of the pump can be adjusted.

It will be appreciated that the signal pressure provided from the hydraulic potentiometer of the control piston 28 varies with the position of the control piston 28 within the sleeve 32 (or the control piston cylinder 35). For example, the value of the signal pressure $P_{tc}$ provided to the spring chamber 84 increases as the control piston 28 moves from the maximum displacement position toward the minimum displacement position. In this way, as the force F2 increases with increased pump outlet pressure, the force F1 also increases to counterbalance the force F2. As indicated previously, the force F1 is the combined force applied to the spool 66 by the spring 86 and by the signal pressure within the spring chamber 84. In this way, a force balanced relationship can be maintained with respect to the spool 66 in an axial orientation as the outlet pressure raises and lowers.

In certain examples, a torque control function is provided through the cooperation of two primary elements including a control valve and a hydraulic potentiometer. The control valve can be constructed like a load sense or pressure compensator valve, the features of which are known to those skilled in the art. The hydraulic potentiometer generates a torque limiting signal pressure, $P_{tc}$ which is directed to the control valve spring chamber.

As indicated above, the control valve can be constructed like a standard load sense or pressure compensator valve except a signal pressure, $P_{tc}$, is applied to the spring chamber rather than case pressure or load sense pressure. When the force from pump outlet pressure, $P_{out}$, acting on the right area of the spool of the control valve is higher than the summation of signal pressure, $P_{tc}$, acting on the left area, A, of the spool plus spring preload force, $F_s$, the control valve ports pressure/flow to the control piston to de-stroke the pump.

When the torque control is active, it seeks to balance forces across the spool:

$$P_{out}=P_{tc}+F_s/A$$

The control valve is arranged in a hydraulically parallel circuit with the pressure compensation and load sense to allow override from pressure comp or load sense.

The hydraulic potentiometer generates a signal pressure, $P_{tc}$, that is the product of pump outlet pressure, $P_{out}$, and pump displacement, D. This pressure is ported to the spring chamber of the control valve. $P_{tc}$ increases proportional to $P_{out}$ and decreases proportional to displacement, D:

$$P_{tc}=\begin{cases} P_{out}, & D=0 \\ 0, & D=100\% \end{cases}$$

Expressed in closed form:

$$P_{tc}=P_{out}(1-D)$$

When the hydraulic potentiometer provides a signal pressure according to the above relationship, a constant torque limit is achieved. This function is accomplished through two primary components: The control piston (moving with the swash plate) and the sleeve (connected to the housing) in which the piston translates.

With regard to the hydraulic potentiometer, the spiral groove feature creates as a long, narrow, 'pipe'—connecting $P_{out}$ to $P_{tank}$ (zero gage pressure). Along this pipe, the pressure drop from $P_{out}$ to $P_{tctank}$ is linear along the length of the pipe. A spiral groove is preferable to create the 'pipe' feature, rather than a fixed clearance annular leak or straight axial groove(s), as it is much more robust in providing a linear signal (critical to torque limit accuracy) when dealing with manufacturing tolerances. The spiral feature is robust to variation in annular clearance between the piston and the bore as well as eccentricity and tilting of the piston within the bore.

With regard to the control piston 28, the annular clearance between the housing bore (i.e., the sleeve bore) and the piston OD is very small compared to the cross-sectional area of the spiral, so the vast majority of the flow is along the spiral path. Since the spiral wraps around the piston many times the 'pipe' length is quite long, which creates a low flow situation and allows for a consistent pressure drop when manufacturing tolerances are considered.

The signal pressure, $P_{tc}$, picks up the pressure at a point along the piston that is fixed relative to the housing/sleeve. Its position and the axial length and start/end positions of the spiral feature are arranged such that it reads outlet pressure at zero displacement and tank pressure at full displacement. As the control piston moves linearly with pump displacement, the signal pressure reads pressure linearly to displacement (for a given $P_{tc}$).

Since the signal pressure reads pressure along the 'pipe' linearly with displacement (1−D), and the pressure along the 'pipe' is scaled linearly to outlet pressure, $P_{out}$, and length along the pipe, the resultant signal pressure provides the desired form: $P_{tc}=P_{out}(1-D)$.

The design intent of a torque control is to limit torque to a constant value, independent of the state of pressure, displacement, pump speed, oil temperature, and torque setting. The basic equation for pump torque, T:

$$T=P_{out}D$$

Review of the 2 primary elements of the control:

1. The control valve acts to maintain a relationship pressure balance such that:

$$P_{out}=P_{tc}+\frac{F_s}{A}$$

2. The hydraulic potentiometer creates a signal pressure:

$$P_{tc}=P_{out}(1-D)$$

Substituting $P_{tc}$ from equations 2 into equation 1:

$$P_{out}=P_{out}(1-D)+\frac{F_s}{A}$$

Expand and reduce:

$$P_{out}=P_{out}-P_{out}D+\frac{F_s}{A}$$

$$P_{out}D=\frac{F_s}{A}$$

And since $$T=P_{out}D$$

$$T=\frac{F_s}{A}$$

An equation for constant torque is thus derived. Since A is fixed, the torque limit is governed by the spring preload alone, $F_s$, meeting the design intent.

In reality, $T=P_{out}D+T_{loss}$ where $T_{loss}$ are inherent mechanical losses in the pump, which have some dependency on pressure, displacement, speed, temperature. Also, in reality $P_{tc}=(P_{out}-P_{ml}+P_{tank})(1-D)$ where:

a. Case pressure, $P_{tank}$, is slightly higher than pump inlet pressure.

b. $P_{ml}$ Are "minor losses" that occur due to the flow transitioning from moving slower over a large area to moving faster in a small area, as well as turning corners (transition from the piston annulus to the spiral groove).

These additional losses would create a significant deviation from a constant torque limit (poor accuracy) if they were ignored. Therefore, adjustments can be made to the 'ideal' design of the valve, sleeve, and piston. These adjustments can mitigate the loss effects—providing a nearly constant torque limit that is robust to manufacturing tolerances and operating conditions. These parameters can be optimized through simulation and test iterations.

As shown previously, the torque control is governed by the equation:

$$T=Fs/A$$

Since the setting is determined by spring preload (as the control valve is active), the only adjustment needed is to adjust the control valve screw: Turn in to increase torque limit; turn out decrease torque limit. A single control setup covers all setting variations (for example, a range from about 20% to about 90% of max.).

A feature can exist in the pump to provide a minimum displacement limit. In this situation, the pump will only operate between the min and max displacements, regardless of operating conditions and control signals. This feature will override all other controls: Pressure compensator, load sense, and torque control.

In one example, the minimum displacement feature is accomplished by simply adding a 'blow hole' to the control piston that is carefully placed (axial position) along the control piston to relieve control pressure to tank—preventing the pump from de-stroking further. The exact hole position to provide the desired minimum swash angle can be developed and verified through test. The minimum displacement setting is not externally adjustable, but can be changed by removing the control piston and replacing it with a different control piston that has the desired hole location. A maximum displacement setting of the pump can be adjusted by a structure such as an adjustable stop (e.g., a screw stop) that limits a range of movement of the control piston 28.

Aspects of the present disclosure can have numerous advantages such as:

1. Parallel control—No loss/degradation of pressure compensation or load-sense functions. Hereinafter, pressure compensation and load sense are referred to as base control.
   a. Much like the parallel nature of pressure compensator and load sense functions, the torque control valve is arranged in parallel to the base control.
   b. A check valve allows for the base control functions to override the torque control and port pressure/flow to the control piston to further destroke the pump in certain operation conditions.
2. High-accuracy control and low cost.
   a. Hydraulic potentiometer naturally produces continuously variable feedback to enable tracking to the ideal hyperbolic pressure-flow curve.
   b. Competitive designs utilize a dual-spring arrangement to create an approximation to the required pressure vs. flow hyperbolic curve. This results in a double-hump torque curve with lower accuracy.
3. Externally adjustable torque setting—No disassembly required.
   a. The torque setting is adjusted simply by adjusting the screw in the control valve.
   b. A single control covers all setting variations (20% to 90% of max.)
      i. This is possible due to the inherent function of the hydraulic potentiometer in creating a hyperbolic relationship between pressure and displacement.
   c. Competitive controls require disassembly of the pump to change out spring sets to achieve different torque settings (and maintain accuracy), in addition to adjusting screws.
      i. A plurality of springs to can be arranged to provide a variable rate spring and approximate the required hyperbola for a given torque setting. However, as the required hyperbola changes for different torque settings the approximation deviates from ideal, creating unacceptable accuracy. Competitive designs are then forced to create several sets of springs to approximate the broad range of required hyperbolic pressure-displacement curves (for the range of torque settings).
4. Hydraulic displacement feedback—Reliable and stable performance.
   a. Since the feedback is purely hydraulic, it provides a smooth and stable feedback, without mechanical failure modes.
   b. Competitive designs that utilize more complex multi-spring feedback mechanisms are prone to mechanical failure and resonant instabilities.
   c. Other competitive designs utilize a spring-loaded cam sliding on a surface profile that translates with displacement (usually cut in the control piston). These designs are prone to wear at the cam-slider interface in addition to mechanical failures.
5. Available with optional minimum displacement limiter—Ensures a minimal flow (overrides controls).
   a. Since the minimum displacement limiter is hydraulic, it eliminates the mechanical failure modes.
   b. Since the limiter is hydraulic, it also provides a 'soft landing' rather than a hard stop at the minimum displacement.

The spool 66 can be configured to have a dual diameter configuration. For example, the spool 66 can have a larger diameter, A, that is acted upon by $P_{tc}$, and a smaller diameter, B, that is acted on by $P_{out}$. As described above, an initial pressure drop occurs ("minor losses") as the oil transitions from the large annulus around the control piston to the small 'pipe' as the oil velocity increases. The dual diameter is critical to mitigating the effects of minor losses as well as pump losses.

This pressure drop is proportional to $P_{out}$. So the actual $P_{tc}=P_{out}(1-\beta)(1-D)$ where $\beta$ is a constant coefficient for the fraction of pressure lost due to minor losses.

The area A is sized to compensate for the pressure losses. Ideally, A is sized proportionally larger than B by $$\frac{A}{B}=\frac{1}{1-\beta}$$

so that the force is balanced across the spool: $AP_{tc}+F_s=BP_{out}(1-D)$

The area difference is further refined to compensate for the inherent mechanical losses in the pump: A piston pump will inherently have losses that vary as a function of pressure and displacement. These inherent losses create an upward or downward trend of the torque limit as a function of pressure/displacement. The area difference is tuned to adjust the trend up/down to further achieve a constant torque limit.

The area difference is further refined to compensate for $P_{out}$ leakage in the spring cavity: Deviating from ideal, the flow from $P_{out}$ to $P_{tc}$ ds slightly higher than $P_{tc}$ to $P_{tank}$ due to the leakage from the spring chamber to tank across the spool. This creates slightly higher pressure drop gradient along the first part of the pipe. The area ratio is slightly adjusted to accommodate this leakage.

The deviation from ideal (constant) torque limit due to minor losses, case pressure, and mechanical efficiencies are further mitigated through adjustment of the timing of the hydraulic potentiometer. Recall that in the ideal case:

$$P_{tc}=\begin{cases} P_{out}, & D=0 \\ 0, & D=100\% \end{cases}$$

The actual losses are mitigated further (to get a constant torque limit) by adjusting the axial location of the $P_{tc}$ sensing location and $P_{out}$ feed in the sleeve as well as the start and end of the spiral groove in the piston. This has an effect on both the proportionality and offset of the signal pressure, $P_{tc}$, relative to displacement, D.

$$P_{tc}=P_{out}(1-a+bD)$$

Aspects of the present disclosure can relate to the control piston providing a negatively proportional signal pressure. The negatively proportional signal pressure allows for the mitigating properties of the dual-diameter spool arrangement, as discussed previously, to be designed into the control valve. A positively proportional signal would not allow this—In the positively proportional arrangement (like PVH pump control), $P_{tc}$ acts directly on the right nose (area A) of the control valve and the spring chamber is at tank pressure. This arrangement also allows better control response to changes in $P_{out}$ pressure. When the pressure changes in this design, it immediately acts on the nose of the control valve causing the control to react quickly. The positively proportional signal arrangement and direct-acting arrangement (not differential pressure) requires the $P_{out}$ changes to be reflected through the spiral groove feature before acting on the nose of the control valve—resulting in a more sluggish response and greater pressure overshoot and slower flow recovery.

Various modifications and alterations of this disclosure will become apparent to those skilled in the art without departing from the scope and spirit of this disclosure, and it should be understood that the scope of this disclosure is not to be unduly limited to the illustrative examples set forth herein.

What is claimed is:

1. A hydraulic pump system comprising:

a variable displacement pump having an outlet, the variable displacement pump including a rotating group having a rotor that is rotated about an axis of rotation by torque from an input shaft, the rotating group being mounted within a pump housing, the rotor defining a plurality of cylinders, the rotating group also including a plurality of pistons that reciprocate within the cylinders as the rotor is rotated about the axis of rotation to provide a pumping action that directs hydraulic fluid out the outlet and provides an outlet pressure, the variable displacement pump also including a swash plate that can be pivoted relative to the axis of rotation to vary a stroke length of the pistons thereby varying a displacement volume of the pump, the swash plate being movable between a maximum pump displacement position and a minimum pump displacement position, the swash plate being biased toward the maximum pump displacement position;

a control piston for controlling a pump displacement position of the swash plate, the control piston being mounted to slide axially within a control piston cylinder, the control piston having a first end adapted to receive a biasing force from the swash plate and a second end adapted to receive a displacement control force generated by a control pressure that acts on the second end of the control piston, the biasing force and the displacement control force being in opposite directions, the control piston including a first zone adjacent the first end of the control piston and a second zone adjacent the second end of the control piston, the first and second zones being defined by outer cylindrical surfaces of the control piston, the control piston also including a third zone between the first and second zones of the control piston, the third zone including a hydraulic fluid passage defined by a groove that extends helically about the control piston from the first zone to the second zone, the first zone being exposed to a case pressure corresponding to the pump housing and the second zone being exposed to outlet pressure from the outlet of the variable displacement pump, and the control piston cylinder defining a signal pressure output location in fluid communication with the groove of the third zone of the control piston, the signal pressure output location being positioned closer to the first zone than the second zone when the control piston is in a position corresponding to the maximum pump displacement position of the swash plate, and the signal pressure output location being positioned closer to the second zone than the first zone when the control piston is in a position corresponding to the minimum pump displacement position of the swash plate; and a torque control valve that controls the control pressure supplied to the second end of the control piston, the torque control valve including a spool that slides axially within a valve bore to control a magnitude of the control pressure supplied to the second end of the control piston, the spool having a first end and an opposite second end, the torque control valve also including a spring that applies a spring force to the first end of the spool, wherein the spring is positioned within a spring chamber of the torque control valve, wherein the spring chamber is in fluid communication with the signal pressure output location of the control piston cylinder such that a signal pressure taken from the signal pressure output location is applied to the spring chamber, wherein the signal pressure applies a signal pressure force to the first end of the spool, wherein the second end of the spool is in fluid communication with the outlet of the variable displacement pump such that the outlet pressure supplies an outlet pressure force applied to the second end of the spool, wherein the outlet pressure force opposes the spring force and the signal pressure force, wherein the signal pressure force acts on a first active surface area at the first end of the spool, wherein the outlet pressure force acts on a second active surface area at the second end of the spool, and wherein the first active surface area is larger than the second active surface area, wherein when the outlet pressure force exceeds a combination of the spring force and the signal pressure force, the spool is moved by a force imbalance to a position where the control pressure provided to the second end of the control piston is increased causing the control piston to move the swash plate toward the minimum displacement position, and wherein when the outlet pressure force is less than the combination of the spring force and the signal pressure force, the spool is moved by the force imbalance to a position where the control pressure provided to the second end of the control piston is decreased causing the control piston to move the swash plate toward the maximum displacement position.

2. The hydraulic pump system of claim 1, further comprising a control piston sleeve mounted within the control piston cylinder, the control piston sleeve defining a bore within which the control piston is slideably mounted, wherein the control piston sleeve defines the signal pressure output location.

3. The hydraulic pump system of claim 1, wherein the spring force is adjustable without requiring disassembly of the torque control valve.

4. The hydraulic pump system of claim 3, further comprising a threaded member that is turned to adjust a degree of compression of the spring thereby adjusting the spring force.

5. The hydraulic pump system of claim 1, wherein the signal pressure output location is located at an interface between the first and third zones when the control piston is in a position corresponding to the maximum pump displacement position of the swash plate, and wherein the signal pressure output location is located at an interface between the second and third zones when the control piston is in a position corresponding to the minimum pump displacement position of the swash plate.

6. The hydraulic pump system of claim 1, wherein the swash plate is spring biased toward the maximum pump displacement position.

7. The hydraulic pump system of claim 1, wherein the pump system has maximum and minimum pump displacement position limits.

8. The hydraulic pump system of claim 1, wherein the maximum pump displacement position is defined by a stop engaged by the second end of the control piston, and wherein an axial position of the stop is adjustable to adjust the maximum pump displacement position.

9. The hydraulic pump system of claim 1, wherein the control piston defines a pressure relief passage that relieves control pressure to case pressure when the control piston reaches a position corresponding to the minimum pump displacement position of the swash plate.

10. A hydraulic pump system comprising:

a variable displacement pump having an outlet, the variable displacement pump including a rotating group having a rotor that is rotated about an axis of rotation by torque from an input shaft, the rotating group being mounted within a pump housing, the rotor defining a plurality of cylinders, the rotating group also including a plurality of pistons that reciprocate within the cylinders as the rotor is rotated about the axis of rotation to provide a pumping action that directs hydraulic fluid out the outlet and provides an outlet pressure, the variable displacement pump also including a swash plate that can be pivoted relative to the axis of rotation to vary a stroke length of the pistons thereby varying a displacement volume of the pump, the swash plate being movable between a maximum pump displacement position and a minimum pump displacement position, and the swash plate being biased toward the maximum pump displacement position;

a control piston for controlling a pump displacement position of the swash plate, the control piston being mounted to slide axially within a control piston cylinder, the control piston having a first end adapted to receive a biasing force from the swash plate and a second end adapted to receive a displacement control force generated by a control pressure that acts on the second end of the control piston, the biasing force and the displacement control force being in opposite directions, the control piston including a first zone adjacent the first end of the control piston and a second zone adjacent the second end of the control piston, the first and second zones being defined by outer cylindrical surfaces of the control piston, the control piston also including a third zone integrated with the first and second zones and positioned between the first and second zones of the control piston, the third zone including a hydraulic fluid passage defined by a groove that extends helically about the control piston from the first zone to the second zone, the first zone being exposed to a case pressure corresponding to the pump housing and the second zone being exposed to outlet pressure from the outlet of the variable displacement pump, and the control piston cylinder defining a signal pressure output location in fluid communication with the groove of the third zone of the control piston, the signal pressure output location being positioned closer to the first zone than the second zone when the control piston is in a position corresponding to the maximum pump displacement position of the swash plate, and the signal pressure output location being positioned closer to the second zone than the first zone when the control piston is in a position corresponding to the minimum pump displacement position of the swash plate; and a sleeve mounted within the control piston cylinder, the sleeve defining a bore within which the control piston is slideably mounted, wherein the sleeve defines the signal pressure output location, and wherein the signal pressure output location is an annulus inside the bore of the sleeve, the control piston being moveable between a first position and a second position, and the annulus being adjacent an interface between the first and third zones when the control piston is in the first position and the annulus being adjacent an interface between the second and third zones when the control piston is in the second position.

11. The hydraulic pump system of claim 10, further comprising:

a control system that includes the control piston, the control system decreases the displacement volume of the variable displacement pump in response to an increase in the outlet pressure and increases the displacement volume of the variable displacement pump in response to a decrease in the outlet pressure.

12. A control piston arrangement for controlling a pump displacement position of a swash plate of a variable displacement pump, the control piston arrangement comprising:

a control piston mounted to slide axially within a control piston cylinder, the control piston having a first end adapted to receive a biasing force from the swash plate and a second end adapted to receive a displacement control force generated by a control pressure that acts on the second end of the control piston, the biasing force and the displacement control force being in opposite directions, the control piston including a first zone adjacent the first end of the control piston and a second zone adjacent the second end of the control piston, the first and second zones being defined by outer cylindrical surfaces of the control piston, the control piston also including a third zone between the first and second zones of the control piston, the third zone including a hydraulic fluid passage defined by a groove that extends helically about the control piston from the first zone to the second zone, the first zone being exposed to tank pressure and the second zone being exposed to outlet pressure corresponding to an outlet of the variable displacement pump, and the control piston cylinder defining a signal pressure output location in fluid communication with the groove of the third zone of the control piston, the signal pressure output location being positioned physically closer to the first zone than the second zone when the control piston is in a position corresponding to a maximum pump displacement position of the swash plate, and the signal pressure output location being positioned closer to the second zone than the first zone when the control piston is in a position corresponding to a minimum pump displacement position of the swash plate; and a sleeve mounted within the control piston cylinder, the sleeve defining a bore within which the control piston is slideably mounted, wherein the sleeve defines the signal pressure output location, and wherein the signal pressure output location is an annulus inside the bore of the sleeve, the control piston being moveable between a first position and a second position, and the annulus being adjacent an interface between the first and third zones when the control piston is in the first position and the annulus being adjacent an interface between the second and third zones when the control piston is in the second position.

13. The control piston arrangement of claim 12, wherein the third zone is integral with the first and second zones of the control piston, and wherein the third zone is a potentiometer that generates a torque limiting pressure signal to provide a pressure balancing function with respect to a spool of a torque control valve.

14. The control piston arrangement of claim 13, wherein the third zone of the control piston is configured for fluid communication with a port of a torque control valve to provide the torque limiting pressure signal from the potentiometer to a spring chamber controlling movement of a spool inside the torque control valve.

15. The control piston arrangement of claim 14, wherein pressure provided to the annulus varies linearly as the control piston moves between the first and second positions due to the hydraulic fluid passage defined by the groove in the third zone decreasing the pressure in a linear manner from the interface between the second and third zones of the control piston to the interface between the first and third zones of the control piston.

* * * * *